United States Patent [19]

Lindstrom

[11] 4,376,691

[45] Mar. 15, 1983

[54] ELECTROLYTIC CELL ESPECIALLY FOR CHLORALKALI ELECTROLYSIS WITH AIR ELECTRODE

[76] Inventor: Olle Lindstrom, Lorensviksvagen 14, S-18363 Täby, Sweden

[21] Appl. No.: 187,845

[22] PCT Filed: Mar. 1, 1979

[86] PCT No.: PCT/SE79/00043

§ 371 Date: Nov. 2, 1979

§ 102(e) Date: Nov. 2, 1979

[87] PCT Pub. No.: WO79/00688

PCT Pub. Date: Sep. 20, 1979

[30] Foreign Application Priority Data

Mar. 2, 1978 [SE] Sweden ..... 7802414

[51] Int. Cl.[3] ..... C25B 9/00; C25B 11/03; C25B 11/08; C25B 13/06

[52] U.S. Cl. ..... 204/265; 204/266; 204/283; 204/290 R; 204/291; 204/292; 204/294; 204/295; 204/296

[58] Field of Search ..... 204/255-258, 204/265-266, 283, 295-296, 291, 294; 429/15

[56] References Cited

U.S. PATENT DOCUMENTS

| | | | |
|---|---|---|---|
| 3,262,868 | 7/1966 | Juda | 204/265 X |
| 3,616,442 | 10/1971 | Cheng et al. | 204/265 X |
| 3,809,630 | 5/1974 | De Nora et al. | 204/266 X |
| 3,864,236 | 2/1975 | Lindström | 204/266 X |
| 4,035,255 | 7/1977 | Gritzner | 204/266 X |
| 4,181,776 | 1/1980 | Lindstrom | 429/27 |
| 4,191,618 | 3/1980 | Coker et al. | 204/283 X |
| 4,244,793 | 1/1981 | Johnson et al. | 204/291 |

*Primary Examiner*—Donald R. Valentine

*Attorney, Agent, or Firm*—Burns, Doane, Swecker & Mathis

[57] ABSTRACT

An electrolytic cell is provided suitable for chloralkali electrolysis comprising a housing; an anolyte chamber in the housing; an anode disposed within the anolyte chamber; at least one cathode spaced from the anode with at least one portion of the cathode being adjacent said anolyte chamber, the cathode including a cathode chamber, means to supply and remove oxygen and remove alkali hydroxide catholyte from the cathode chamber; and a multi-layer wall defining a boundary between the anolyte chamber and the interior of the cathode chamber comprising a permeable separator material adjacent the anolyte chamber, a foraminous electrically conductive supporting material adjacent the interior of the cathode chamber, and at least partially hydrophobic electrocatalytically active material suitable for the reduction of oxygen adjacent the separator material and the supporting material.

5 Claims, 7 Drawing Figures

ELECTROLYTIC CELL ESPECIALLY FOR CHLORALKALI ELECTROLYSIS WITH AIR ELECTRODE

The energy cost is a heavy item in the calculus for electrolytically produced chlorine and alkali. An increasing cost for electrical energy will accentuate these circumstances further. Technical developments in the chlor-alkali field therefore has an objective to reduce the energy consumption in the electrolytic process. One possibility to reduce the cell voltage is to introduce air cathodes so as to eliminate the energy consuming hydrogen development in the cathode fingers. Hydrogen being developed in conventional electrolysers seldom finds a meaningful use at the chlor-alkali plants. Introduction of air cathodes will reduce the cell voltage with something between 0.5–1 volt depending on the current density, the temperature and the activity of the air electrode. This reduction of the cell voltage will evidently have very great importance for the economics of the chlor-alkali process.

The inventors have therefore shown a certain interest in this question and there are several designs of chlor-alkali cells with air cathodes described in the literature, see e.g. the U.S. Pat. No. 3,262,868.

Another more radical possibility is to introduce a bifunctional hydrogen electrode at the same time in order to adjust the production of chlorine and alkali to the market demand with the minimum sacrifice of electrical energy for every specific market profile for chlorine respectively alkali, see the U.S. Pat. No. 3,864,236.

A particularly advantageous design for air cathodes which are quite useful for bi-polar chlor-alkali cells is shown in the German Offenlegungsschrift No. 2627142. 1-41.

Chlorine and alkali are produced on a very large scale in all industrialized countries and the amount of capital which has been invested in these chlor-alkali plants is very large. The useful life of these plants is also quite long. It is not unusual that plants last 20–30 years and even longer. However, it is necessary to renovate the cells at frequent intervals, change anodes, put on new diaphragms etc. It has also been possible to develop existing cells towards better performance e.g. by the introduction of so-called dimensionally stable anodes instead of graphite anodes in mercury cells as well as in diaphragm cells. These different cell types are described e.g. in Kirk-Othmer "Encyclopedia of Chemical Technology", Second Edition, Volume 1, pp. 668–707, J. S. Sconce "Chlorine" ACS monograph No. 154, 1962, and e.g. the U.S. Pat. Nos. 3,124,520, 3,262,868 and other publications and patents. Pertinent information which is quite up to date from many point of views is found in the Proceedings from the Chlorine Bicentennial Symposium, ECS, 1974, and Hardie: "Electrolytic Manufacture of Chemicals from Salt" The Chlorine Institute 1975.

Work up to day to develop and introduce air cathodes in chlor-alkali electrolysis has been concerned with the task to develop a completely new electrolytic cell e.g. by means of bi-polar electrode designs. Much would be gained however if a design could be envisaged which would make it possible to introduce air cathodes in existing cells of diaphragm or membrane type with monopolar electrodes. Such air electrodes could then be used with existing electrolytic plants and thus immediately give very important global conservation of electrical energy. The operating costs for the chlor-alkali process would also be reduced considerably with such modification. It is fair to say that such an innovation would be even more important than the earlier introduction of dimensionally stable anodes.

One objective for the present invention is therefore to make possible conversion of existing chlor-alkali cells of diaphragm or membrane type with monopolar electrodes to air electrodes.

A second objective is to reduce the consumption of electrical energy for the electrolysis considerably due to the fact that also existing plants may be converted to air electrodes.

A third objective is to furnish a design which makes possible simple renovation of the air electrode on the same occasion as exchange of dimensionally stable anodes, membranes or diaphragms.

A fourth objective is to reduce the chloride content in the alkali hydroxide solution.

A fifth objective is to increase the concentration of the product solution particularly with diaphragm cells.

Other objectives will be apparent from the description.

The characteristic feature of the air electrodes for electrolysers according to the invention is that it forms a space which is separated from the surrounding outer anolyte, the surface of said space being covered with a separator consisting of an asbestos diaphragm or a cation permeable material; electrocatalytically active material, which is at least partly hydrophobic, disposed therein whereby the separator and the electrocatalytically active material are mechanically supported by an electrically conducting supporting structure which is furnished with means for supply and removal of air to a said space; means for removal of the alkali hydroxide solution which is being formed at the reduction of oxygen in the presence of electrolyte which is moving into said space from the surrounding outer space through the separator; and means to bring air and alkali hydroxide solution in contact with the side of the electrocatalytically active material which is facing the interior of said space.

It shall be immediately remarked that the principle of the air electrode as described above differs in a very important respect from the state of art air electrodes for chlor-alkali cells since the electrolyte is brought into contact also with the back side of the air electrode (front side here means that side of the electrode which is facing the counter electrode, in this case the chlorine anode, back side is the other side of the electrode). Conventional air electrodes have during normal operation no electrolyte in contact with the back side of the electrode, see e.g. U.S. Pat. No. 3,864,236 and 3,262,868.

This new design principle gives a number of practical and process technical advantages. One such practical advantage is of course that the air electrode according to the invention makes possible a functioning chlor-alkali cell with air electrodes. These practical advantages should be apparent from the following description. It has, however, also been found that the invention produces several very surprising process technical advantages compared to conventional air electrodes with catholyte disposed on the front side of the air electrode and not on its back side according to the present invention. It is thus possible to produce a more concentrated alkalihydroxide solution with the embodiment for diaphragm cells which reduces steam requirements for the concentration operation. Another advantage of great importance is that the chloride concentration will be lower which is of particular importance for the diaphragm cells.

The very low energy consumption, the high alkali concentration and the low chloride concentration are factors of outmost importance for the economics of the chlor-alkali electrolysis. The present invention has in common with several other inventions in the chlor-alkali field, like dimensionally stable anodes, dimensionally stable diaphragms and efficient membranes, constructive simplicity combined with very high technical efficiency. The invention is meeting the objectives which were formulated above in every respect. The invention shall now be described by means of a few examples. The air electrode can be introduced along three routes:

(1) Addition to existing diaphragm and membrane cells with a minimum of constructive modification.
(2) Radical modification of the cathode supporting parts of the cell including the cathode element at existing diaphragm and membrane cells.
(3) Completely new design of the whole electrolyser so as to get an optimized embodiment of the invention.

The invention shall now be described by means of the following drawings.

Figure 1A:
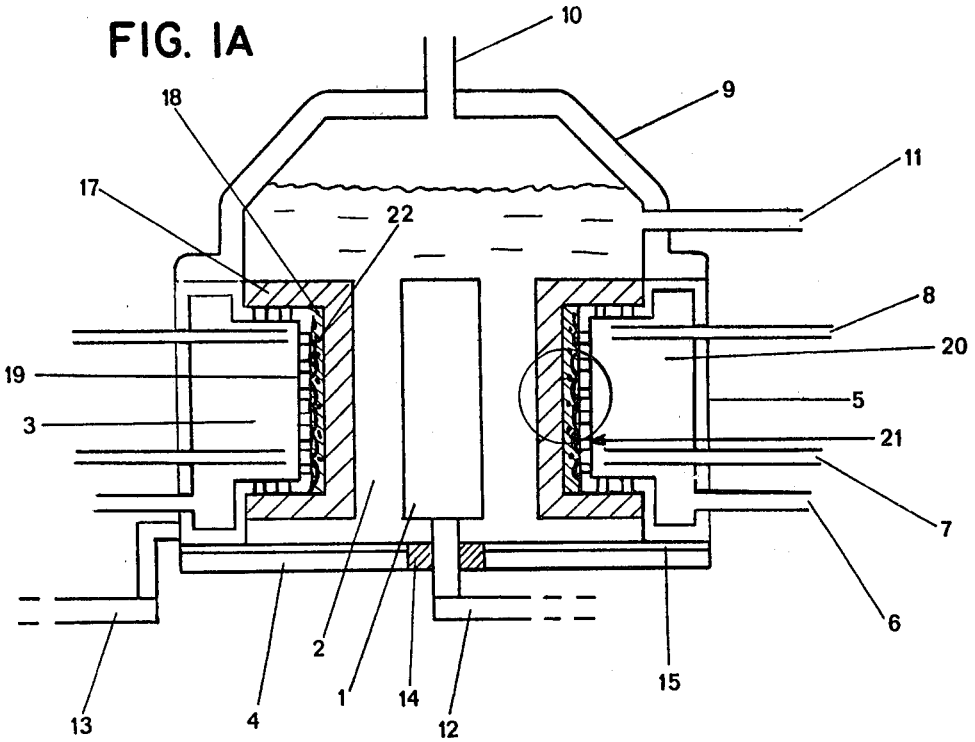
FIG. 1 shows in a schematic way the arrangement of the functional elements of a chlor-alkali cell with air electrode according to the invention.

In order to save space the description will be mainly concerned with the constructive design of the new air electrode. The state of art in chlor-alkali technology is well described in the standard references referred to above. Present designs of diaphragm and membrane cells are described in printed material published by the leading companies in the field, Hooker Chemicals and Diamond Shamrock. A detailed flow-sheet for a modern chlor-alkali plant with diaphragm cells has been produced by Diacell AB in Gävle, Sweden, 1977. The artisan will experience no difficulty to introduce and use the electrodes according to the invention for chlor-alkali electrolysis without any further advices in the present description.

It should however be remarked that conversion from hydrogen development to oxygen reduction will involve a few simple changes which can easily be carried out by the artisan. The sensible heat in the hydrogen gas stream is frequently recovered for the evaporation of the alkali hydroxide solution. The sensible heat in the warm air stream leaving the cathode spaces may be utilized in the same way. Sometimes hydrogen is used as a fuel in boilers for production of process steam. These steam generators must of course operate on a different fuel in the future. Piping which has been installed in an existing plant for the hydrogen system may be kept to be used for the air system after change from hydrogen development to oxygen reduction.

The requirement for air, oxygen enriched air or oxygen for the oxygen reduction of course depends on the oxygen concentration in the supplied gas. If pure oxygen is used the supply will amount to about half of the earlier hydrogen flow on a volume basis in view of the stoichiometrics of the reaction. Inert components present in the oxygen may in this case be vented off periodically to prevent that the concentration of these inert components, like argon and nitrogen, will increase in the cathode spaces. When operating on air it may frequently be suitable with an excess corresponding to the double oxygen requirement, whereby the supply of air will amount to about five times the corresponding flow of hydrogen in the hydrogen mode of operation. In this case about half of the oxygen supplied will be consumed in the electrode reaction whereas remaining oxygen will leave with the outgoing air. It may sometimes be of advantage with preheat and moistening of the air supply. Sometimes one may also have use for the cooling and drying effect of supply of cool and dry air to the cathode space. It may also sometimes be of advantage to recirculate air back to the cathodes spaces after enrichment with fresh air, oxygen enriched air or oxygen. Such recirculation may also be of advantage to reduce the uptake of carbon dioxide by the alkali hydroxide solution. All these questions are to be viewed upon as practical questions of optimization which can be easily decided by the artisan from case to case depending on the operating conditions in question, desired product quality, etc.

The carbon dioxide content of the air is a chapter on its own. This carbon dioxide is taken up by the alkali hydroxide solution and causes an increased content of carbonate in the electrolyte. In certain applications it is desirable to minimize the carbonate concentration and it is then necessary to first remove the carbon dioxide of the air in a special scrubber where the air is scrubbed preferably with an alkali hydroxide solution which is then decarbonized in known manner e.g. by means of electrodialys or causticising, etc.

The design of the system for air supply does not present any problems for the artisan which is apparent from the description above.

Change from hydrogen development to oxygen reduction at an existing plant requires a special procedure for the change-over which has to be decided from case to case depending on the extent of cell modification. It is frequently desired to carry out the change-over step by step without disturbing the production and furthermore it is desired to use the facilities which are available for cell maintenance. It is then useful to utilize mobile aggregates for individual air supply to a cell unit. After a cell has been rebuilt it will be put back on its place in the cell hall and connected to the system excluding the pipe for outgoing hydrogen. The air supply is then connected whereafter the cell will run on oxygen reduction with no other interference with the system. In this way one may successfully modify a certain number of cells and then join this group to the common air system. When a sufficient number of cells have been converted the common hydrogen system is to be disconnected. Of course one may also follow other policies e.g. complete stop of production during the change-over period or connection of the converted cells to the new common air system already from the beginning. The much lower cell voltage with chlor cells with air cathodes also requires either modification of the electrical supply system or expansion of the cell hall so that the available system voltage will be used fully. In this way improved economy of operation may be combined with capacity increase.

The active materials in a chlor-alkali cell has limited life and it is therefore necessary to remove a cell from time to time for renovation or a change of e.g. diaphragm. The electrocatalytically active material in the air electrode has also limited life. It is therefore useful to choose materials and operating conditions so that exchange or reactivation of the electrocatalytically active material may take place with the same time intervals as other operations of maintenance. Of course it is of a particular advantage to regenerate the electrocatalytically active material simultaneously with regeneration or exhange of diaphragm or membrane respectively. It is of course also extremely important that the air electrode is designed in such a way that the electrocatalytically active material can be easily regenerated or exchanged. It is of course particularly useful to apply this material on the supporting structure by spraying, painting, dipping, electrophoretic precipitation or in other ways without use of mechanical operations.

The materials which are used in air electrodes according to the invention are presently used in the chlor-alkali technology, the fuel cell technology, metal air battery technology, etc. As separator materials may be used diaphragms or membranes of the type that is now being used in chlor-alkali cells. Different kinds of diaphragms are described in the U.S. Pat. Nos. 3,694,281, 3,723,264 and others. Also other types of diaphragms or membranes for chlor-alkali cells may be used.

Publications pertaining to so-called Nafion membranes are found e.g. in the Proceedings from the Electrochemical Society's meeting in Georgia, Oct. 9–14, 1977, pp 1135–1150.

The electrocatalytically active material contains catalysts for oxygen reduction of known type on the basis of active carbon, silver basis, metal oxides containing nickel and cobalt, so-called perovskite- and spinel structures and of course noble metal catalysts. These catalysts, containing conducting additives in the form of carbon, graphite, nickel powder and structure stabilizing additives like carbides, nitrides, etc. are bonded together to a porous structure of thin thickness frequently a few tenths of a millimeter preferably by means of sintered particles of Teflon. This will at the same time give the desired hydrophobic property to improve the air contact. This technology is now established above all by progress that has been made in the fuel cell field. Here can be referred to the Swedish published applications 300.246, 329.385, 369.006, 349.130, 333.783, 371.913, 5742/72, Power Sources Symposium No. 6 and 7, Siemens Berichte 5, 1976, pp 266–271.

The mechanically supporting structure may in all important parts be designed according to designs which have been developed for cathode fingers, see e.g. U.S. Pat. No. 2,987,463. The supporting structure can be manufactured by nickel-coated carbon steel or other combinations of materials which are resistant in the alkaline environment at the electrode potential for oxygen reduction in question. If the diaphragm is fabricated in known manner by dipping the structure in a slurry of asbestos fibre whereafter vacuum is put on the interior of the air electrode, the structure must of course be furniched with an interior support to take up the outside pressure. These interior supports are with advantage designed so that they simultaneously serve as baffles to bring supplied air in contact with the electrocatalytically active material disposed on the walls of the inner space.

After this report on available known techniques which can be utilized in the application of the invention I shall now describe the constructive design of the air electrodes. I will now limit myself to the mechanical structure and may then rely in recommendations in the above description.

Figure 1B:
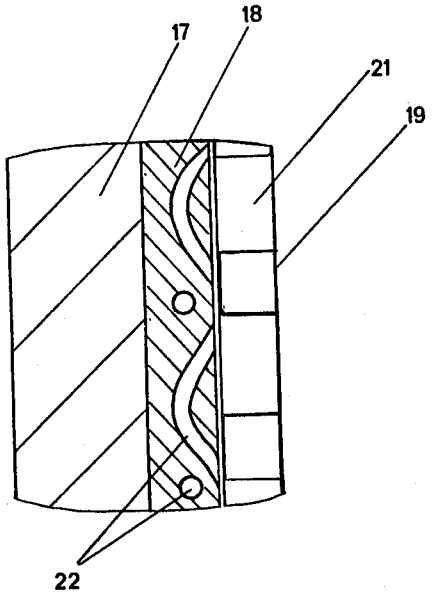

FIG. 1 shows completely schematically the functional design of a chlor-alkali cell with air electrode according to the invention. For the sake of simplicity only one single cell element is shown containing a so-called dimensionally stable chlorine anode (1) with a surrounding anolyte room (2) and the air cathode with its inner room (3). A cellbase plate (4) carries the anodes. The cathodes are disposed at the cell wall part (5) with means (6) for discharge of alkali hydroxide solution and means (7) and (8) for supply and discharge of process air respectively. The cell cover (9) contains a pipe for discharged chlorine (10) and a connection for supply of alkali chloride solution (11). Supply of electrical energy takes place by the connectors (12) and (13) respectively. The anode is insulated from the cellbase plate by the insulation (14) and the cellbase plate is of course electrically insulated from the cell wall part (5) with the insulating gasket (15).

As the artisan easily realizes, FIG. 1 shows in principle a completely conventional chlor-alkali cell with exception for the new electrode. (The drawing is however so to say constructively misleading since the air electrode is at the same time shown in a section by the surface which is facing the anode and in a section through the cell-wall part.) In reality the air electrode will look from the outside very much the same as a cathode finger in a conventional chlor-alkali cell. The air electrode contains the separator material (17) which may be an asbestos diaphragm or a Nafion membrane, the electrocatalytically active material (18) which may be a Teflon-bonded porous Raney silver catalyst or active carbon catalyst, the perforated or foraminous supporting structure (19) which delimits the inner room (3) of the air electrode. The supporting structure (19) is furnished with openings (21) and is preferably Teflon-coated so as to make the whole supporting structure electrolyte repellant and thereby facilitate capture of air bubbles for better contact between air and the electrocatalytically active material (18). It may furthermore be of advantage to make use of a special supporting material (22) for the electrocatalytically active material. This supporting material could be a nickelwire mesh arranged on the supporting structure, porous graphite or carbon paper etc. The supporting material may also be applied on the interior side of the supporting structure.

Figure 2:
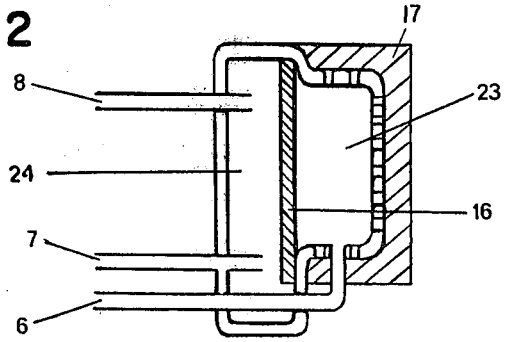
FIG. 2 shows in the same way a corresponding cell wall part for a similar cell with a conventional air electrode.

FIG. 2 shows a conventional air electrode in a cell of the same type. Inspection of the figure reveals that there is here a special catholyte room (23) arranged between the separator (17) and the air cathode (16) which is not permeable for electrolyte, and a special gas room for air (24). This cathode is thus functionally built up in the same way as has been described for gas diffusion electrodes for electrolysers in the U.S. Pat. No. 3,864,236.

In the operation of the cell according to FIG. 1 the air is supplied via the conduit (7) and is then brought into contact with active electrode material being exposed via openings (21) in the supporting structure (19). The inner room is filled up by a more or less continuous air phase and a more or less continuous electrolyte phase, whereby the distribution between air and electrolyte depends on the constructive design of the inner room, the hydrophobization, the baffles, the supporting structure, etc.

Figure 3:
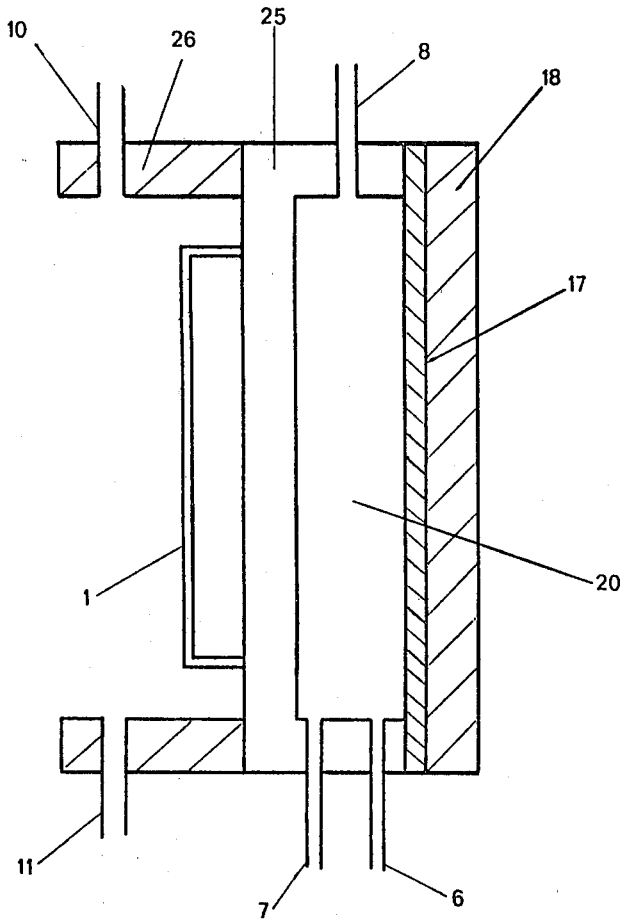
FIG. 3 shows the functional design of a bi-polar electrolytic cell with air electrodes according to the invention.

FIG. 3 shows how the invention may be used with bi-polar cells. This figure is also a pure principal sketch which shows the fundamental function. The figure shows a repetitive element in a pile of bi-polar electrodes (25) with intermediate insulating frame elements (26). The notations are the same as in the preceding figures. The separator (17) is here preferably a cation permeable membrane like Nafion.

Figure 4:
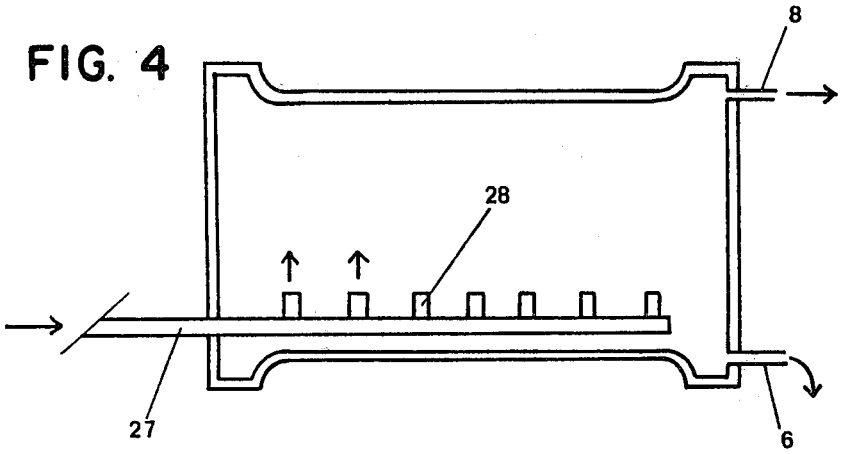
FIG. 4 shows how a conventional cathode with hydrogen development may be modified so as to serve as an air electrode according to the invention for a chlor-alkali cell e.g. of the type being developed by Hooker Chemicals, with a minimum of modification in other respects.

FIG. 4 shows how the essential design according to FIG. 1 can be achieved by rebuilding an existing chlor-alkali cell. For simplicity FIG. 4 shows only a section through the supporting structure. The cell-wall part with its cathode fingers has been dismounted in a known way and the asbestos diaphragm has been removed. To begin with the structure has been nickel-coated galvanically in the known way. A thin nickel wire mesh (22) has been disposed in such a way that it covers the perforated or foraminous part of the structure. This nickel wire mesh shall serve as support for the electrocatalytical active material. Furthermore an air distributor (27) with holes (28) for supply of air evenly over the inner section of the cathode finger has been introduced in every cathode finger. This air distributor is connected to a main line not shown for incoming air which in its turn is connected to the common air system. The electrocatalytically active material is then put on the nickelwire mesh by painting of a thin layer (0,1 mm) of a slurry of Raney silver of so-called Siemen's type (see reference above). A suspension of 100 grams of silver in 100 grams Teflon dispersion (DuPont Teflon 30 N) is sufficient for 1 Sq.m. The nickel wire mesh should have a mesh number above 60. Sintering is taking place at 350° C. for 15 minutes in air.

In order to facilitate transfer of electrolyte through the hydrophobic layer (which is frequently disposed on the air side of state of art air electrodes), the layer is perforated with rollers with needles so as to produce holes in the layer. These holes, frequently 0,2–1 mm in diameter may cover minor part of the electrode surface frequently in the range of 1–10%. After the electrode material structure has been sintered together e.g. by heating up to 300° C. for 20 minutes the asbestos diaphragm is supplied in known manner. It is also possible to sinter the electrocatalytically active material and the diaphragm in one and same operation.

The modified cell wall part may now be mounted on its cell base plate in the cell hall with the difference that the connection to the hydrogen system is substituted for connection to the system for discharged air and furthermore that the air space is connected to the system for air supply.

An important thing is of course the adjustment of the hydraulic resistance for transfer of electrolyte from the anolyte room to the interior of the air electrode. One has here to find out by experimentation suitable hydrophobization, pore structure and eventual perforation of the active air electrode material. One may also simultaneously reduce the thickness of the diaphragm considering the transport resistance offered by the air electrode. (It is also possible to make diaphragm and electrode materials in to one unit which may be described as elimination of the separator.) There are in principal two possibilities. In one case the electrolyte is allowed to "weep" from the anolyte room into the interior room of the air electrode to be collected in the lower part of the air electrode whereby the air electrode is mainly filled up with air. The transfer of electrolyte into the catholyte room is depending on complicated electro-osmotic and other transport processes in the membrane and is only to a minor extent depending on the hydrostatic pressure differential between the two rooms. In the other case the catholyte space is mainly filled up with electrolyte and the driving force for transport between the anolyte room and the interior of the air electrode is mainly the hydrostatic pressure difference. This requires thus that the air electrode is perforated as has been described above. A good contact is still obtained between the air and the electrocatalytically active material since the air bubbles are collected at the openings in the supporting structure. The air bubbles are hereby transported successively from level to level in the air electrode.

Figure 5:
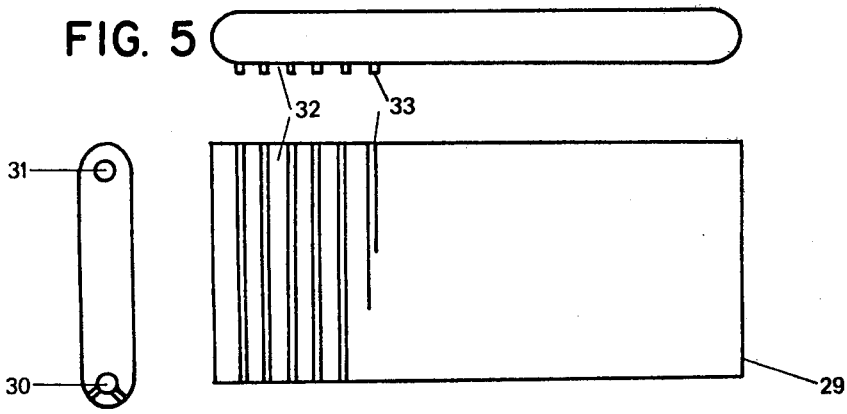
FIG. 5 shows a special embodiment with a porous electrolyte holding body disposed in the interior of the air electrode.

FIG. 5 shows another useful embodiment with a porous electrolyte-holding structure (29) disposed in the interior of the air electrode. This electrolyte-containing structure may be manufactured in position within the cathode finger by sintering of alkali-resistant polymers like polysulfon, penton, polyphenyleneoxide, etc., whereby the open porosity is produced by means of spacers like particles of sodium chloride which are then leached away. The electrolyte containing structure also contains channels for addition of air (30), respectively discharge of air (31), and channels (32) to produce contact between the air and the electrocatalytically active material. The electrolyte-containing structure furthermore contains ribbons (33) or other contact points for conducting electrolyte from the electrocatalytically active material to the electrolyte containing structure. This design gives a completely controlled distribution of air and electrolyte in the air electrode with a controlled contact between electrolyte, air and the electrocatalytically active material.

Figure 6:
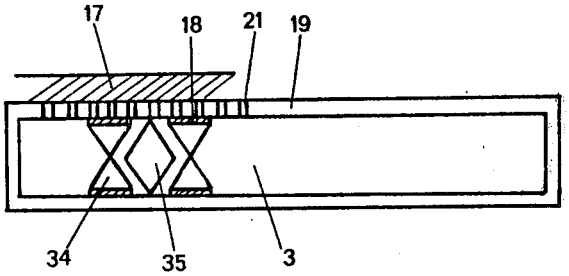
FIG. 6 shows another special embodiment with an air electrode to be used with membrane cells whereby the electrode is sectioned in elements intended for air, respectively electrolyte.

FIG. 6 shows another special embodiment with separate air element and electrolyte elements disposed in the interior of the electrode. FIG. 6 shows a view from above with standing perforated elements (34) and (35), with electrode material (18) on the surface of the element (34) against the separator. These elements are thus inserted in the cathode fingers. The air is conducted towards the bottom of each element (34). Alkali is flowing in the element (35) and is filling up this element almost completely. Other means according to FIG. 1 are not shown in the drawing.

Laboratory experiments with function models in principle designed as in FIG. 3 and furnished with material as described above have shown that the electrode can be run at 150 mA/cm$^2$ at 80° C., whereby cell voltage is reduced from 3,25 volt for corresponding conventional cell to 2,40 volt. On the basis of these experiments a complete redesign of an existing chlor-alkali plant for diaphragm cells with a capacity of 70,000 metric tons of chlorine per year has been carried out. Specific energy consumption is reduced with 24%, the alkali concentration can be increased to 18% and the capacity increased with 33% without change of the electrical system.

There is no difficulty for the artisan to get the same kind of improvement with other existing plants by means of air electrodes according to the invention. There are furthermore no difficulties to new-design cells containing air electrodes according to the invention, whereby the operational and practical advantages become even more significant.

What has been said above and described by examples and drawings shall not be considered a limitation of the scope of this invention. There are other possibilities within the scope of this invention for the artisan to make use of the spirit of this invention.

I claim:

1. An electrolytic cell comprising:

a housing;

an anolyte chamber in said housing;

an anode disposed within said anolyte chamber;

at least one cathode spaced from said anode with at least one portion of the cathode being adjacent said anolyte chamber, the cathode including a cathode chamber;

means to supply and remove oxygen from the cathode chamber;

means to discharge an alkali hydroxide catholyte solution from the cathode chamber; and a multi-layer wall defining a boundary between the anolyte chamber and the interior of said cathode chamber comprising a permeable separator material adjacent said anolyte chamber, a foraminous electrically conductive supporting material adjacent the interior of said cathode chamber, and at least partially hydrophobic electrocatalytically active material suitable for the reduction of oxygen adjacent said separator material and said supporting material.

2. The electrolytic cell of claim 1 wherein the separator material is selected from the group consisting of an asbestos diaphragm and a cation-permeable membrane.

3. The electrolytic cell of claim 1 wherein the electrocatalytically active material is bonded to a thin porous structure disposed between the separator material and the foraminous supporting material.

4. The electrolytic cell of claim 1 wherein said electrocatalytically active material is selected from the group consisting of active carbon, nickel, oxide, cobalt oxide, and noble metals or compounds thereof.

5. The electrolytic cell of claim 3 wherein said thin porous structure comprises a nickel wire mesh.

* * * * *